US006149266A

United States Patent [19]

Cook

[11] Patent Number: 6,149,266

[45] Date of Patent: Nov. 21, 2000

[54] METHOD AND APPARATUS FOR FILLING A RIGID CLOSED VOLUME THROUGH A SEPTUM

[75] Inventor: William Paul Cook, Lexington, Ky.

[73] Assignee: Lexmark International, Inc., Lexington, Ky.

[21] Appl. No.: 09/074,214

[22] Filed: May 7, 1998

[51] Int. Cl.[7] ..... B41S 2/175

[52] U.S. Cl. ..... 347/85

[58] Field of Search ..... 347/85, 86; 222/80; 604/86, 88, 411; 141/285, 329, 330, 363

[56] References Cited

U.S. PATENT DOCUMENTS

| | | | |
|---|---|---|---|
| 4,537,593 | 8/1985 | Alchas . | |
| 4,794,409 | 12/1988 | Cowger et al. . | |
| 4,831,389 | 5/1989 | Chan . | |
| 5,367,328 | 11/1994 | Erickson | 347/7 |
| 5,369,429 | 11/1994 | Erickson | 347/7 |
| 5,454,409 | 10/1995 | McAffer et al. | 141/329 |
| 5,509,140 | 4/1996 | Koitabashi et al. | 347/86 |
| 5,517,867 | 5/1996 | Ely et al. | 141/329 |
| 5,629,727 | 5/1997 | Erickson | 347/85 |
| 5,686,947 | 11/1997 | Murray et al. | 347/85 |

FOREIGN PATENT DOCUMENTS 6-106729 4/1984 Japan .

*Primary Examiner*—N. Le
*Assistant Examiner*—Judy Nguyen
*Attorney, Agent, or Firm*—B. Franklin Griffin, Jr.; D. Brent Lambert

[57] ABSTRACT

A container having a fixed volume sealed from the atmosphere by an elastic septum is filled with liquid via a needle inserted through the septum, the needle providing a path for liquid flow into the fixed volume from an external source through the septum and a path for air flow from the fixed volume to atmosphere through the septum. The needle includes a stem having a hollow tube with a non-cylindrical section and a cover element cooperating with the non-cylindrical section of the tube to form an air passage and give the stem a cylindrical configuration even in the region of the non-cylindrical section of the tube. The configuration of the stem minimizes damage to the septum as the stem is inserted through or withdrawn from a septum, while the air passage permits air to exit from the container through the stem as liquid enters the container through the tube.

17 Claims, 2 Drawing Sheets

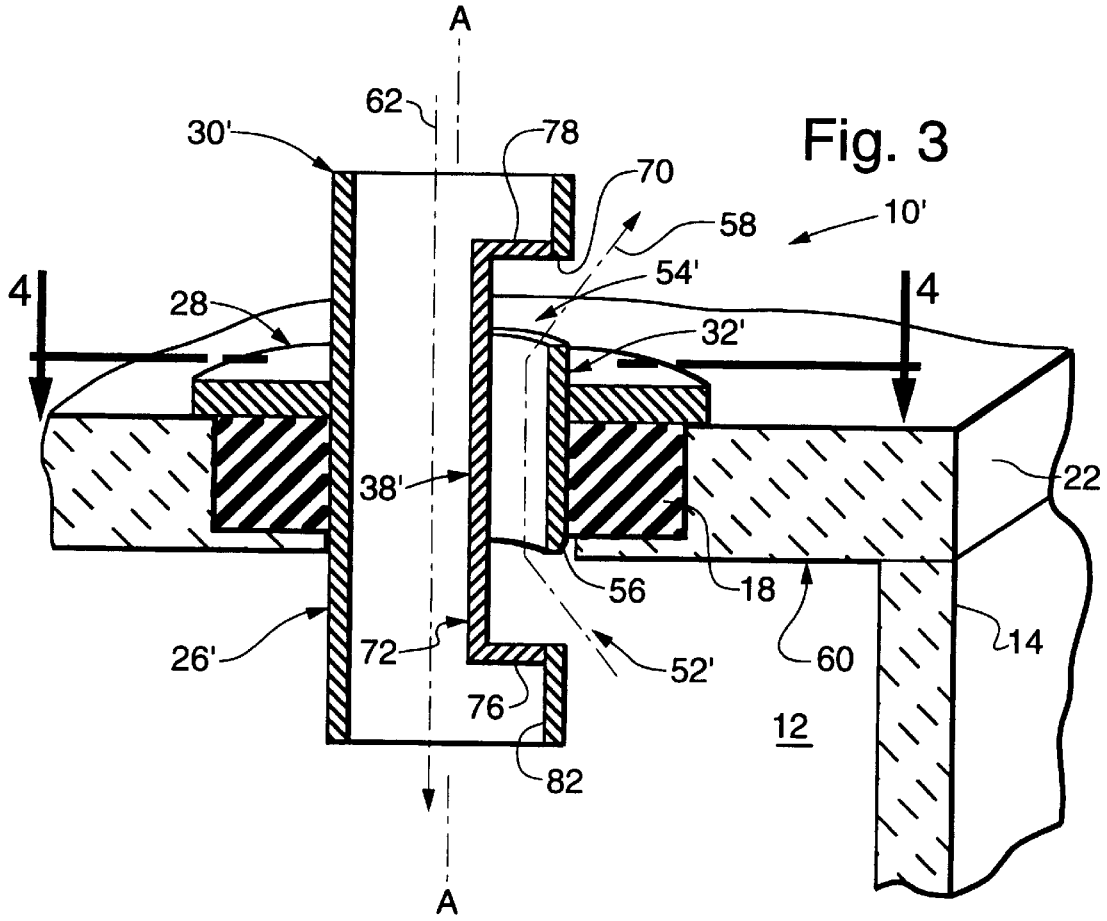
Fig. 3
Fig. 4
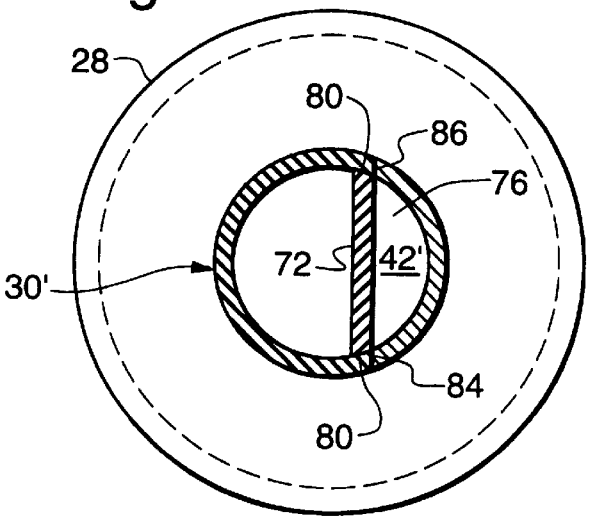
Fig. 5
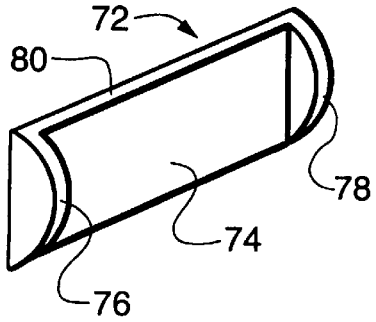

METHOD AND APPARATUS FOR FILLING A RIGID CLOSED VOLUME THROUGH A SEPTUM

RELATED APPLICATIONS

This application incorporates by reference the disclosure of the concurrently filed application of Cook et al., Ser. No. 09/074,215, U.S. Pat. No. 6,095,643 entitled Refillable Disposable Inkjet Cartridge With Foam-Filled and Free Ink Reservoirs.

FIELD OF THE INVENTION

This invention relates to a method and apparatus for filling a closed volume with liquid through a pierceable elastic barrier, the liquid entering the volume and air vented from the volume passing through separate passages in a needle that extends through a piercing in the barrier. More particularly, the invention provides a needle for injecting ink into a printhead cartridge (or off-board ink reservoir) of an ink jet printer through a piercing in an elastic barrier, the needle also providing an air path for venting air from the cartridge through the piercing.

BACKGROUND OF THE INVENTION

To permit filling, or to permit the withdrawal of ink, the ink containers in some ink jet printers are provided with an opening that is scaled by an elastic septum. In many cases the ink container (printhead cartridge or off-board reservoir) is a flexible bag. These bags are easily filled with ink by inserting a hollow needle through the septum and injecting ink from a syringe or other ink supply reservoir. However, if the container is a rigid body with a fixed volume then a second opening into the container has been required, the second opening permitting air to escape from the container as it is being filled through the first opening.

With at least one cartridge design it is not always possible to evacuate air from a container that is filled through an elastic septum, even if two openings are provided. For example, the concurrently filed application referenced above discloses a printhead cartridge partitioned into a free ink reservoir and a foam-filled ink reservoir, the free ink reservoir being provided with an opening that is sealed by an elastic septum. The two reservoirs are connected by an ink passage and, prior to cartridge use, the foam-filled reservoir is open to the atmosphere. As a step in the manufacturing process, a hollow needle is inserted through the septum to fill the free ink reservoir. During filling, the free ink reservoir is vented through the ink passage so that pressure in the free ink reservoir is relieved. However, an air bubble guard surrounds the ink passage so that air can not be completely forced from the free ink reservoir as the reservoir is being filled. Thus, there is a need for some way to fill rigid ink reservoirs and other rigid containers through a septum while at the same time permitting air to escape from the container through the septum.

SUMMARY OF THE INVENTION

An object of this invention is to provide a needle for filling with liquid a container having a fixed volume and an opening sealed with a pierceable elastic barrier, the needle being cylindrical in shape and providing a first passage through which liquid flows into the container and a second passage through which air is vented from the container.

Another object of the invention is to provide a needle, insertable through a pierceable elastic barrier to fill a container with a liquid, the needle comprising an elongated cylindrical hollow stem having therein a liquid flow passage and an air flow passage, the air flow passage terminating at two ports in a peripheral surface of the stem, the ports being spaced apart in an axial direction by a distance greater than the thickness of the barrier. The stem is provided with a stop for limiting penetration of the stem into the container so that, at the limit of stem penetration, one of the ports is inside the container immediately adjacent the barrier and the other port is outside the container.

In one embodiment, the stem comprises a hollow tube having a non-cylindrical section intermediate cylindrical ends of the tube, and an arcuate cover element secured to the tube at the non-cylindrical section, the cover element comprising a wall of the air passage and, with an outer surface of the tube, providing a cylindrical outer surface for the stem at the non-cylindrical section of the tube.

In a second embodiment, the tube has an opening at the non-cylindrical section, the cover element having edges extending in the axial direction and secured to edges of the opening, the needle further comprising a closure element secured to an interior surface of the tube for closing the opening and, with the cover element, defining the air passage.

A further object of the invention is to provide a combination comprising a container having a fixed interior volume, the container having an opening in the top thereof sealed by a pierceable elastic barrier, and a needle for filling the interior volume with a liquid, the needle comprising an elongated cylindrical hollow stem for piercing the barrier by movement in an axial direction, the stem having therein a liquid flow passage and an air flow passage, the air flow passage terminating at two ports in a peripheral surface of the stem, the ports being spaced apart in the axial direction by a distance greater than the thickness of the barrier in the axial direction, and means for stopping axial movement of the stem when one of the ports is inside the volume and another of the ports is outside the container.

Yet another object of the invention is to provide a method for completely filling with liquid a container having a fixed volume sealed by a pierceable elastic barrier, the method comprising deforming a hollow cylindrical tube intermediate ends of the tube to provide first and second cylindrical end sections joined by a non-cylindrical section, securing an arcuate member to the non-cylindrical section to form a stem having a cylindrical periphery at the non-cylindrical section of the tube and an air path between the tube and the arcuate member, inserting the needle through the barrier until the air path communicates with the fixed volume and with atmosphere outside the container, and supplying liquid to the container through the tube.

Other objects and advantages of the invention will become obvious upon consideration of the following description and the accompanying drawings.

BRIEF DESCRIPTION OF THE DRAWINGS

FIG. 3 is a sectional view of a needle according to a second embodiment of the invention;

FIG. 4 is a sectional view taken along the line 4—4 of FIG. 3; and,

FIG. 5 is a perspective view of the closure member of FIG. 4.

DESCRIPTION OF A PREFERRED EMBODIMENT

Figure 1:
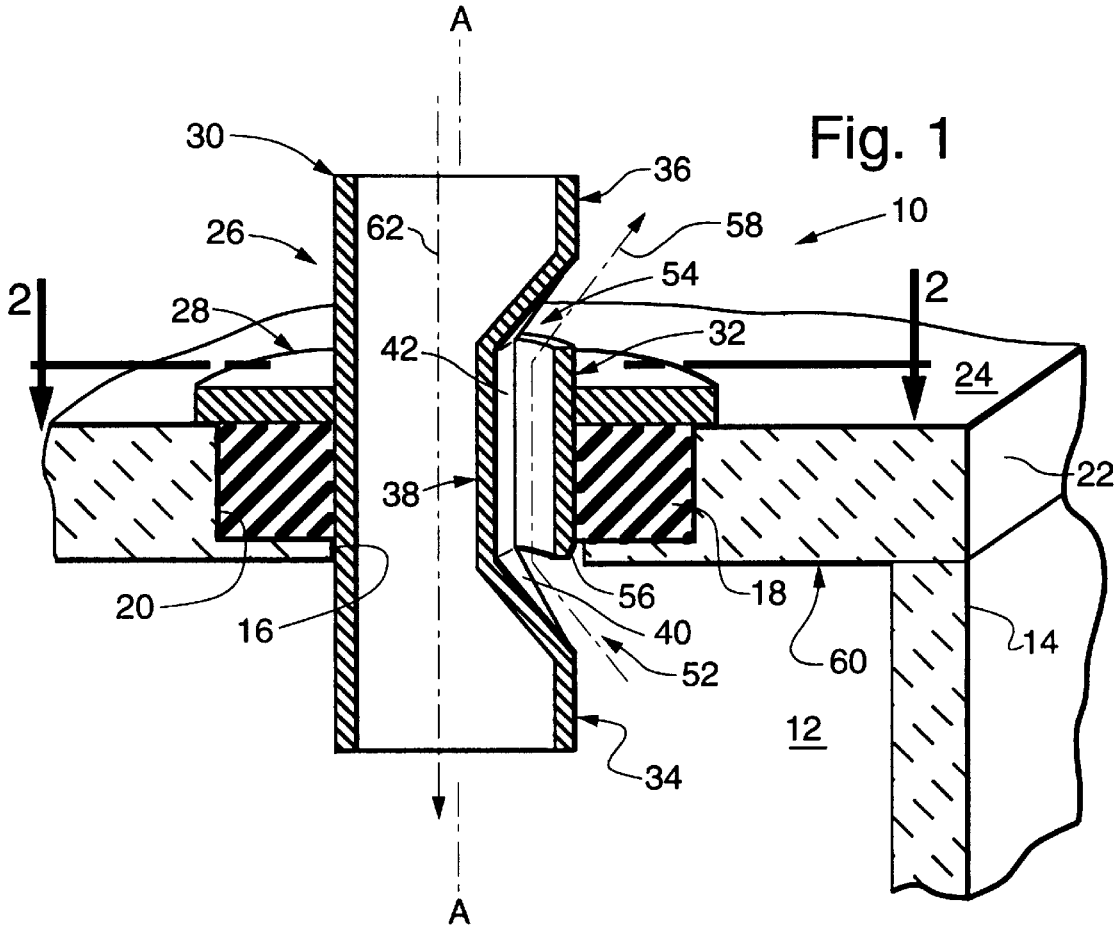
FIG. 1 is a sectional view of a needle according to a first embodiment of the invention.

FIG. 1 is a part sectional view illustrating a needle 10 for filling a fixed volume 12 enclosed by a container 14. The container may be any receptacle for holding a liquid but for purposes of the present description the container is assumed to be the body of a disposable ink cartridge for an ink jet printer.

The cartridge body 14 has an opening 16 therein that is sealed by a pierceable barrier 18, the barrier being illustrated as disposed in a recess 20 in the cover or top wall 22 of the cartridge body. The barrier may be secured to cover 22 by glue, or may be held in the recess by mechanical means such as a needle guide as described in the application referenced above. The barrier need not be disposed in a recess but may be secured to the top surface 24 of the cover 22. The barrier 18 is conventional and comprises an elastic septum made of rubber or another elastic material with sufficient elasticity to seal opening 16 when needle 10 is withdrawn from the opening. As used herein, the term 'pierceable barrier' means a barrier which may be pierced or a barrier which has been pierced, the piercing being closed due to the elasticity of the material from which the barrier is made.

Needle 10 comprises a stem 26 and a positioning ring 28. Stem 26 comprises an elongated hollow tube 30 and a cover element 32. Tube 30 has a cylindrical first or lower end 34 and an upper end 36 joined by a non-cylindrical section 38. The lower end may have a blunt tip as shown in FIG. 1 or a pointed tip. In some applications, such as the filling of a cartridge during manufacture, a pointed tip is preferable to pierce a barrier which has not previously been pierced.

Figure 2:
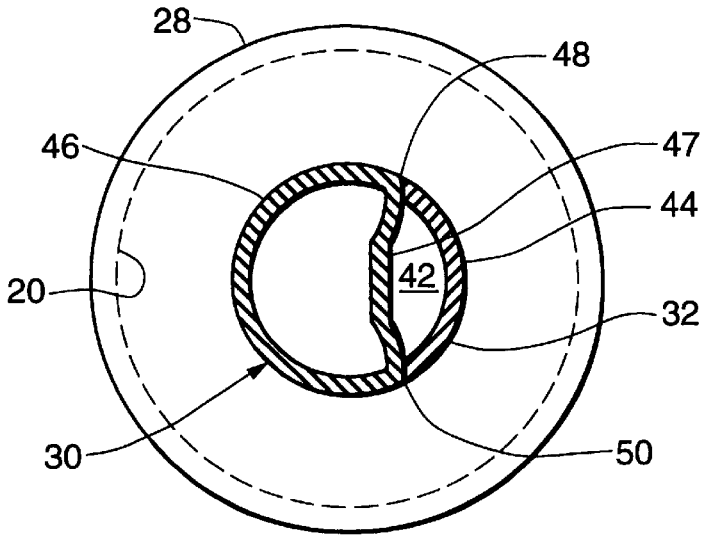
FIG. 2 is a sectional view taken along the line 2—2 of FIG. 1.

The outer peripheral surface of the non-cylindrical section 38 includes a cylindrical surface 46 (FIG. 2), and a non-cylindrical surface 47 which may be formed by collapsing or depressing the outer peripheral surface of the tube 30 so as to form an indentation 40 (FIG. 1).

The cover element 32 serves to cover indentation 40 thereby forming an air passage 42. Cover element 32 is an arcuate member with an outer surface 44 having the same radius of curvature as the outer peripheral surface 46 of tube 30. This permits edges 48,50 of the element to be glued or otherwise secured to the tube surface 46 where the surface begins bending from its cylindrical configuration to form the indentation 40. The length of cover element 32 in the axial direction is less than the length of the indentation 40 so that the cover element and tube 30 together form first and second ports 52,54 at respective ends of the air passage 42.

When the edges 48,50 of cover element 32 are secured to surface 46, the stem 26 has a cylindrical cross-section even where tube 30 is non-cylindrical. This configuration permits better wiping of ink from stem 22 as it is withdrawn from the elastic barrier 18 and, more importantly, minimizes damage to the barrier as the stem is inserted into and withdrawn from the barrier. To further minimize such damage the bottom edge 56 of the cover element may be chamfered.

As previously stated, the cover element 32 should have an axial length that is less than the axial length of the indentation 40 so that ports 52 and 54 are formed. On the other hand, the cover element should have an axial length somewhat greater than the thickness of the elastic barrier 18.

The purpose of ring 28 is to limit downward movement of needle 10 as the stem 26 is inserted into the cartridge. The ring is glued or otherwise secured to tube 30 and cover element 32 at an axial position such that when the ring abuts the upper surface 24 of the cartridge 14, the chamfered edge 56 on the cover element extends just barely through the elastic barrier 18 as shown in FIG. 1. The chamfered edge 56 preferably does not extend below the bottom surface 60 of cartridge cover 22. If this edge does extend below surface 60, air adjacent the surface will be trapped and will not exit the cartridge as the cartridge is filled with ink. When the cartridge 14 is oriented in an upright position and the bottom edge 56 of cover element 32 is at or above the level of the upper interior surface 60, essentially all air in the cartridge will be forced therefrom along path 58 as ink is injected into the cartridge along the path 62 from an external source (not shown) connected to the upper end section 36.

Depending on the design of the cartridge 14, positioning ring 28 may not be required. For example, the above-mentioned application describes a cartridge having a Luer-Lock fitting which secures an ink supply line to the cartridge and connects the supply line to an injection needle carried by the fitting. This arrangement sets the vertical positioning of the needle so that a ring 28 would not be required. It should be noted that such a fitting requires at least a partial revolution of the needle after the stem 26 has been inserted to almost its final position in the elastic barrier 18, the partial revolution then drawing the stem to its final position. Because of the cylindrical configuration imparted to stem 26 by the cover element 32, there is less chance that this turning of the stem will damage the barrier.

The air passage 42 may be formed by methods other than collapsing a section of tube 30. FIGS. 3 and 4 illustrate a needle 10' wherein the stem 26' comprises a hollow cylindrical tube 30' and a cover element 32'. Tube 30' is provided with a non-cylindrical section 38' by cutting away a portion of the tube so as to form an axially extending opening 70 that extends part-way around the tube. The opening 70 is completely closed by a closure element 72 having a configuration as shown in FIG. 5. Closure element 72 comprises an elongated, preferably flat portion 74 joining two end portions 76,78. Flat portion 74 is at least as long as the opening 70. The end portions and the edges 80 of portion 74 have arcuate surfaces with a radius of curvature the same as the radius of curvature of the interior surface 82 of tube 30'. Closure element 72 is glued or otherwise secured to surface 82 to completely close the opening 70.

The cover element 32' is like element 32 but is secured to the axially extending edges 84,86 of tube 30' bounding opening 70. The cover element 32' and the closure element 72 cooperate to define an air passage 42' extending between two ports 52',54' located in the peripheral surface of stem 26. Except for the manner of obtaining the air passage and ports, the needle 10' is like needle 10 and is not further described.

The invention provides a method and apparatus for completely filling a rigid ink cartridge even though the cartridge may have only one opening for entry of ink and that opening is sealed by a pierceable elastic septum. The cartridge 14 is oriented such that the surface 60 is essentially horizontal and needle 10 or 10' is inserted through the septum to provide both an ink passage through which ink flows to fill the cartridge and an air passage for venting the interior of the cartridge to its exterior. Ink is then applied through the upper end 36 of tube 30 from a syringe or off-board ink reservoir (not shown).

What is claimed is:

1. A needle for filling, with liquid, a container defining a fixed volume and having an opening sealed by a pierceable elastic barrier, said needle comprising an elongated hollow stem exhibiting a smooth cylindrical outer surface over its entire length , the stem having therein a liquid flow passage and an air passage, the liquid flow passage extending in an axial direction from a first to a second end of the stem and the air passage terminating at first and second ports in said outer surface, said ports being fixed in said outer surface and spaced apart in said axial direction so that when the stem is inserted through said pierceable elastic barrier, the first port is inside said container and the second port is outside the container.

2. A needle as claimed in claim 1 and further comprising positioning means for stopping insertion of the needle as soon as the first port is inside the container.

3. A needle as claimed in claim 1 wherein said stem comprises a hollow tube having a non-cylindrical section intermediate cylindrical ends of the tube, and an arcuate cover element secured to said tube at said non-cylindrical section, the cover element comprising a wall of said air passage and, with an outer surface of said tube, providing a cylindrical outer surface for the stem at the non-cylindrical section of said tube.

4. A needle as claimed in claim 3 wherein said arcuate cover element has a chamfered edge facing in a direction in which the stem is inserted.

5. A needle as claimed in claim 3 wherein, at said non-cylindrical section, the outer surface of said tube comprises a first surface portion that is cylindrical and a second surface portion that is non-cylindrical, the second surface portion and said cover element forming said air passage.

6. A needle as claimed in claim 3 wherein said cover element has an axial length less than that of the non-cylindrical section and is positioned such that the ports are bounded by the tube and opposite ends of the cover element.

7. A needle as claimed in claim 3 wherein, at said non-cylindrical section, said tube has an opening, the cover element having edges extending in the axial direction and secured to edges of said opening, the needle further comprising a closure element secured to an interior surface of said tube for closing said opening, said closure element and said cover element forming said air passage.

8. A combination comprising: a container having a fixed interior volume, the container having an opening in the top thereof sealed by a pierceable elastic barrier, and a needle for filling the interior volume with a liquid, the needle comprising, an elongated cylindrical hollow stem for piercing the barrier by movement in an axial direction, said stem having a smooth outer peripheral surface of constant diameter said stem having within said diameter, a liquid flow passage and an air flow passage, the air flow passage terminating at two ports in said peripheral surface, the ports being spaced apart in said axial direction by a distance greater than a thickness of the barrier in said axial direction, and means for stopping axial movement of the stem when one of said ports is inside said volume and another of said ports is outside said container.

9. The combination as claimed in claim 8 wherein said container is an ink jet printer cartridge and said liquid is ink.

10. The combination as claimed in claim 8 wherein said stem comprises a hollow tube having a first end portion for attachment to an ink supply, a second, cylindrical end portion for penetrating the barrier, and a non-cylindrical section joining the first end portion and the second end portion, the stem further comprising an arcuate cover element having an outer surface with a radius of curvature the same as an outer surface of the second end portion, said cover element being secured to said non-cylindrical section of the tube to give the stem a uniformly cylindrical surface for penetrating the barrier.

11. The combination as claimed in claim 10 wherein said cover element has a length in the axial direction that is at least as great as said thickness of the barrier.

12. The combination as claimed in 11 wherein, when the stopping means stops axial movement of the stem, a first edge of the cover element is at approximately the level the top of the interior volume.

13. The combination as claimed in 10 wherein the non-cylindrical section of the tube comprises a collapsed part of the tube that has been collapsed from a cylindrical form to provide a non-cylindrical surface, said non-cylindrical surface and said cover element cooperating to form said air passage.

14. The combination as claimed in 10 wherein the non-cylindrical section of the tube comprises a cylindrical section having a hole therein, the stem further comprising a closure element secured to an interior surface of the tube for closing said hole, said closure element and said cover element forming said air passage.

15. The combination as claimed in claim 12 wherein said first edge of the cover element has a chamfered edge facing toward the second end portion of the tube.

16. A needle for filling, with liquid, a container defining a fixed volume and having an opening sealed by a pierceable elastic barrier, said needle comprising an elongated stem having a first end for penetrating said barrier and a second end for connection to a source of liquid, said stem having therein a liquid flow passage extending in an axial direction from said first end to said second end, two ports on said stem, and an air passage within said stem and connecting said ports, said ports being spaced apart in said axial direction so that when the stem is inserted through said pierceable elastic barrier, the first port is inside said container and the second port is outside the container, said first end exhibiting a smooth outer surface over the entire portion thereof that penetrates said barrier.

17. A needle as claimed in claim 16 and further comprising a stopper for stopping insertion of the needle when said ports are on opposite sides of said barrier.

* * * * *